US009976558B2

(12) United States Patent
Yang et al.

(10) Patent No.: US 9,976,558 B2
(45) Date of Patent: May 22, 2018

(54) FAN MODULE

(71) Applicant: HEWLETT-PACKARD DEVELOPMENT COMPANY, L.P., Houston, TX (US)

(72) Inventors: Chienlung Yang, Houston, TX (US); Kuan-Ting Wu, Taichung (TW)

(73) Assignee: Hewlett-Packard Development Company, L.P., Houston, TX (US)

( * ) Notice: Subject to any disclaimer, the term of this patent is extended or adjusted under 35 U.S.C. 154(b) by 280 days.

(21) Appl. No.: 14/632,548

(22) Filed: Feb. 26, 2015

(65) Prior Publication Data

US 2016/0252096 A1 Sep. 1, 2016

(51) Int. Cl.

*F04D 17/04* (2006.01)
*F04D 17/12* (2006.01)
*F04D 25/06* (2006.01)

(52) U.S. Cl.

CPC ..... *F04D 17/04* (2013.01); *F04D 17/127* (2013.01); *F04D 25/0613* (2013.01);
(Continued)

(58) Field of Classification Search

CPC ..... F04D 19/02; F04D 19/064; F04D 19/024; F04D 19/26; F04D 29/231; F04D 29/26; F04D 29/281; F04D 29/282; F04D 29/64; F04D 29/5813; F04D 29/42; F04D 29/28; F04D 29/584; F04D 29/325; F04D 29/181; F04D 29/263; F04D 25/0666; F04D 25/166; F04D 25/026; F04D 25/06; F04D 25/105; F04D 25/163; F04D 25/064; F04D 17/00; F04D 17/08; F04D 17/16; F04D 17/162; F04D 17/164; F04D 17/166; F04D 17/127; F04D 17/04; F04D 29/284;
(Continued)

(56) References Cited

U.S. PATENT DOCUMENTS 3,124,301 A * 3/1964 Helmbold ..... F04D 17/04 415/53.2
6,439,172 B1 * 8/2002 McGovern ..... F01P 5/12 123/41.48
(Continued)

FOREIGN PATENT DOCUMENTS

CN 202811530 3/2013

OTHER PUBLICATIONS

Norton, Robert L. "Chapter 9: Gear Trains." Design of Machinery: An Introduction to the Synthesis and Analysis of Mechanisms and Machines, Second ed., McGraw Hill, 1999, pp. 432-479.*
(Continued)

*Primary Examiner* — Dwayne J White
*Assistant Examiner* — Topaz L Elliott
(74) *Attorney, Agent, or Firm* — HPI Patent Department

(57) ABSTRACT

Example implementations relate to a fan module. The fan module may include an outer impeller having a first plurality of radial blades arranged between an inner circumference of the outer impeller and an outer circumference of the outer impeller. The outer impeller may be rotatable about a first axis of rotation. The fan module may include an inner impeller having a second plurality of radial blades, the inner impeller disposed within the inner circumference of the outer impeller and rotatable about a second axis of rotation.

16 Claims, 5 Drawing Sheets

(52) U.S. Cl.
CPC .... *F05D 2250/312* (2013.01); *F05D 2250/36* (2013.01); *F05D 2260/4031* (2013.01)

(58) Field of Classification Search
CPC .. F04D 29/451; F04D 25/0613; F04D 25/666; F04D 16/024; F04D 19/231; F04D 19/281; F04D 19/282; F04D 29/542
USPC ..... 415/60
See application file for complete search history.

(56) References Cited

U.S. PATENT DOCUMENTS 7,125,226 B2 10/2006 Horng et al.
7,435,051 B2 * 10/2008 Obinelo ..... F04D 17/127 415/228
8,150,561 B2 * 4/2012 Shimotono ..... G06F 1/206 700/299
8,489,250 B2 * 7/2013 Aklilu ..... G05D 23/1917 165/201
9,140,263 B2 * 9/2015 Horng ..... F04D 17/04
2006/0078423 A1 4/2006 Zheng
2010/0172095 A1 7/2010 MacDonald et al.
2012/0002368 A1 1/2012 Broili et al.
2013/0171014 A1 * 7/2013 Horng ..... F04D 17/04 417/423.7
2015/0003007 A1 * 1/2015 MacDonald ..... F04D 29/281 361/679.46
2015/0003974 A1 1/2015 Heymann
2015/0204338 A1 * 7/2015 Tiainen ..... F04D 17/127 415/60

OTHER PUBLICATIONS

C. Chao, "Blade Generator Software for Fan Design", 6 pages, Retrieved Jan. 27, 2015 from http://www.ee.ncut.edu.tw/iee/digitconf/matlab2006expo/doc/cfp/02.pdf.

* cited by examiner

FAN MODULE

BACKGROUND

An electronic device may include various components, such as a processor, an input/output component, a networking component, a memory component, a display component, a storage component, a battery, and/or the like. Such components may generate heat during operation.

BRIEF DESCRIPTION OF THE DRAWINGS

Various examples will be described below with reference to the following figures.

DETAILED DESCRIPTION

An electronic device (e.g., a notebook computer, a tablet computer, a smart phone, a gaming device, or the like) may generate heat while in operation, owing at least in part to its components (e.g., a processor, an input/output component, a networking component, a memory component, a display component, a storage component, a battery, and/or the like). A fan may be employed in or on the electronic device to generate air flow to carry heat away from the electronic device. A fan may have an air inlet and an air outlet that are perpendicular to each other, for drawing air in from a top of the fan and blowing air out a side of the fan. Ventilation performance of such a perpendicular arrangement may relate to the thickness or height of the fan. As electronic devices continue to decrease in size, size constraints on the fan may limit air inlet efficiency and air flow internally. Insufficient air flow can lead to overheating of and damage to the electronic device.

Figure 1:
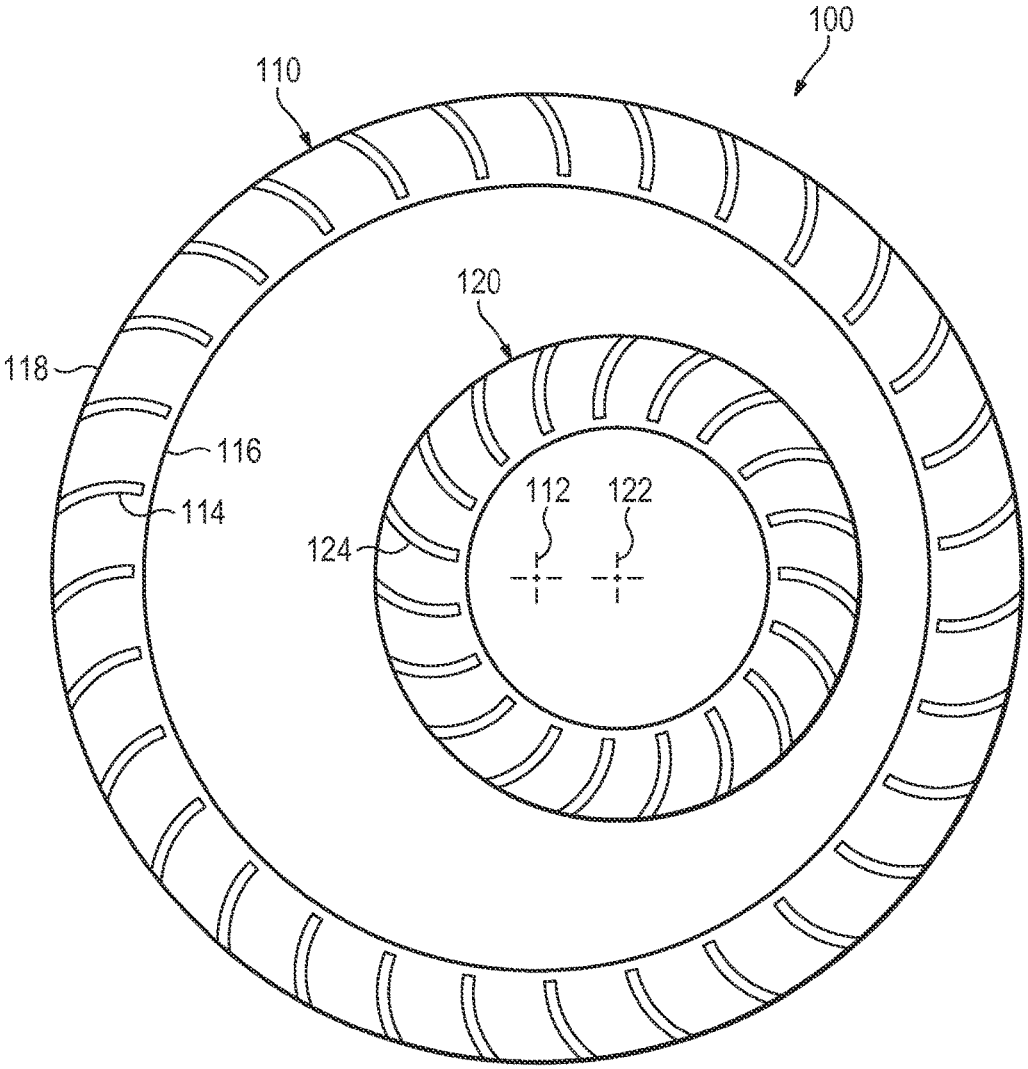
FIG. 1 is a schematic top plan view of an example fan module according to an implementation.

Referring now to the figures, FIG. 1 is a top plan view illustrating an example fan module 100 according to an implementation. In some implementations, the fan module 100 may be used with an electronic device, for example, to ventilate or dissipate heat from the electronic device. As shown in FIG. 1, a fan module 100 may include an outer impeller 110 and an inner impeller 120. The outer impeller 110 may be rotatable about a first axis of rotation 112. For example, the outer impeller 110 may be circular in shape, and the first axis of rotation may pass through the circle center of the outer impeller 110. The outer impeller 110 may have a first plurality of radial blades 114 arranged between an inner circumference 116 of the outer impeller 110 and an outer circumference 118 of the outer impeller 110. As used herein, the term "blades" may also mean vanes, fins, or other suitable member for moving air. The term "radial" may refer to an arrangement generally along a direction radiating from the center of an impeller described herein, such as the outer impeller 110 or the inner impeller 120.

The inner impeller 120 may be rotatable about a second axis of rotation 122. For example, the inner impeller 120 may be circular in shape, and the second axis of rotation 124 may pass through the circle center of the inner impeller 120.

The inner impeller 120 may have a second plurality of radial blades 124. The inner impeller 120 may be disposed within the inner circumference 116 of the outer impeller 110. Accordingly, the inner impeller 120 may be understood to be smaller than the outer impeller 110. In some implementations, the outer impeller 110 and the inner impeller 120 may be nonconcentric, as depicted in FIG. 1. However, FIG. 1 is but one example implementation, and in other implementations, the outer impeller 110 and the inner impeller 120 may be concentric.

Figure 2:
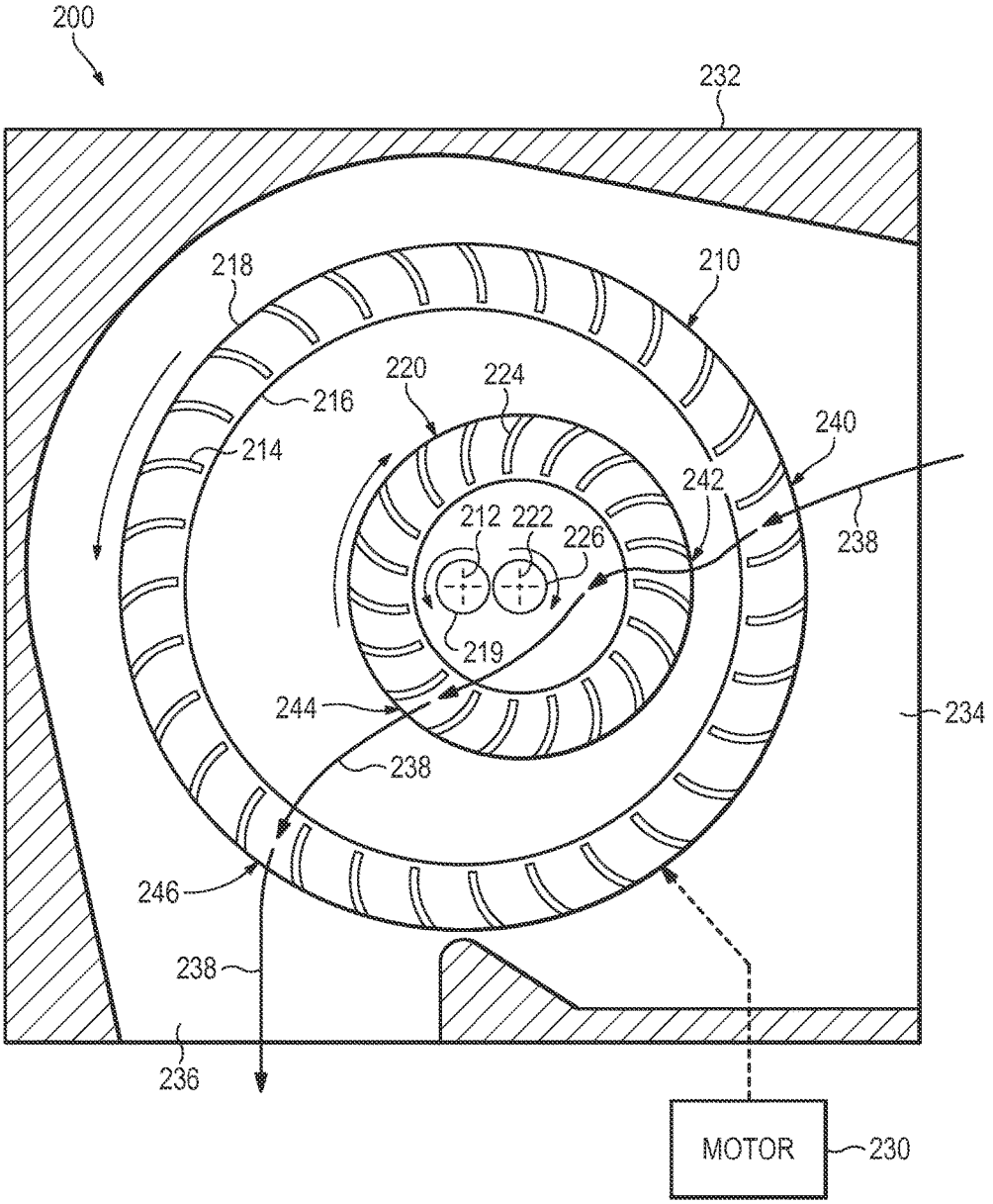
FIG. 2 is a schematic top plan view of an example fan module according to an implementation.

FIG. 2 is a top plan view illustrating an example fan module 200 according to an implementation. In some implementations, the fan module 200 may be used with an electronic device, for example, to ventilate or dissipate heat from the electronic device. A fan module 200 may include an outer impeller 210, an inner impeller 220, and a motor 230. The outer impeller 210 may be analogous in many respects to the outer impeller 110. For example, like the outer impeller 110, the outer impeller 210 may be rotatable about a first axis of rotation 212 and may include a first plurality of radial blades 214 arranged between an inner circumference 216 and an outer circumference 218. In some implementations, the outer impeller 210 may include an outer impeller shaft 219 that is coaxial with the first axis of rotation 212. In some implementations, the outer impeller shaft 219 and the first plurality of radial blades 214 may both be disposed on a disk-shaped or ring-shaped base structure of the outer impeller 210.

The inner impeller 220 may be analogous in many respects to the inner impeller 120. For example, like the inner impeller 120, the inner impeller 220 may be rotatable about a second axis of rotation 222, may include a second plurality of radial blades 224, and may be disposed within the inner circumference 216 of the outer impeller 210. In some implementations, the inner impeller 220 may include an inner impeller shaft 226 that is coaxial with the second axis of rotation 222. In some implementations, the inner impeller shaft 226 and the second plurality of radial blades 224 may both be disposed on a disk-shaped or ring-shaped base structure of the inner impeller 220.

In some implementations, the outer impeller shaft 219 and the inner impeller shaft 226 are coupled together such that rotation of the outer impeller shaft 219 or the inner impeller shaft 226 (e.g., by the motor 230, as will be described below) causes rotation of both the outer impeller 210 and the inner impeller 220. For example, in some implementations, both the outer impeller shaft 219 and the inner impeller shaft 226 may be gear shafts that mesh with one another (or any other suitable mechanism for transmitting rotational motion).

The motor 230 may impart a rotation to the outer impeller 210 or the inner impeller 220, and more particularly, the motor 230 may impart a rotation to the outer impeller shaft 219 or the inner impeller shaft 226. For example, the motor 230 may be coupled to the outer impeller 210 or the inner impeller 220 by a pulley, by a direct drive mechanism, or another mechanism suitable for transferring rotational motion. More particularly, in some implementations, the motor 230 may be coupled to the outer impeller shaft 219 or the inner impeller shaft 226. In some implementations, the motor 230 may be coupled to the outer circumference 218 (e.g., as a roller adjacent to the outer circumference 218 of the outer impeller 210) to impart a rotation to the outer impeller 210.

In some implementations, the inner impeller 220 and the outer impeller 210 may be nonconcentric, owing to their respective shafts being coupled together side-to-side, for example, as depicted in FIG. 2. It should be understood that other suitable arrangements for coupling the inner impeller shaft 226 and the outer impeller shaft 219 may be used such that the inner impeller 220 and the outer impeller 210 may be concentric (e.g., the inner impeller shaft 226 and the outer impeller shaft 219 being coaxial in such implementations).

Moreover, in some implementations, the coupling of the outer impeller shaft 219 and the inner impeller shaft 226 (e.g., direct coupling, as depicted in FIG. 2) may cause the outer impeller 210 and the inner impeller 220 to rotate in opposite directions, as illustrated by the arcuate (arc-shaped) arrows in FIG. 2 along the circumferences of the outer impeller, the inner impeller, the outer impeller shaft, and the inner impeller shaft. In some implementations, outer impeller shaft 219 and the inner impeller shaft 226 may be coupled in a manner that causes the outer impeller 210 and the inner impeller 220 to rotate in the same direction (e.g., coupling by way of an idler gear, not shown).

A speed ratio (also known as a gear ratio) of the fan module 200 may be defined as a ratio of an angular velocity (rotational speed) of the outer impeller 210 to an angular velocity of the inner impeller 220. Where the outer impeller shaft 219 and the inner impeller shaft 226 are coupled together, as described above, the speed ratio may depend on a ratio of a radius of the outer impeller shaft 219 to a radius of the inner impeller shaft 226. For example, in some implementations, the radius of the inner impeller shaft 226 may be greater than the radius of the outer impeller shaft 219, and the speed ratio of the angular velocity of the inner impeller 220 to the angular velocity of the outer impeller 210 is thus less than one, or in other words, the inner impeller 220 rotates or spins slower than the outer impeller 210. In other implementations, the radius of the inner impeller shaft 226 may be less than or equal to the radius of the outer impeller shaft 219, and the speed ratio of the angular velocity of the inner impeller 220 to the angular velocity of the outer impeller 210 is thus greater than or equal to one; that is, the inner impeller 220 rotates or spins faster than the outer impeller 210. In some implementations, the radii of the shafts 219, 226 may be substantially the same (as depicted in FIG. 2), the speed ratio is thus one and the impellers 210, 220 rotate or spin at substantially the same angular velocity.

In some implementations, the fan module 200 may include a housing 232 that has an air inlet 234 and an air outlet 236. The outer impeller 210 and the inner impeller 220 may be disposed within the housing 232. For example, the housing 232 may fully enclose the inner impeller 220 and the outer impeller 210, except for the air inlet 234 and the air outlet 236, which are each openings that allow air flow to/from different sides of the outer impeller 210. It should be understood that a top surface of the housing is not shown in FIG. 2 so as to not obscure the components enclosed within the housing. More particularly, rotation of the outer impeller 210 and rotation of the inner impeller 220 (e.g., as described above) may cause air to flow from the air inlet 234, through a first side 240 of the outer impeller 210 and then a first side 242 of the inner impeller 220 and then the center of the inner impeller 220 and then a second side 244 of the inner impeller 220 and then a second side 246 of the outer impeller 210, and out through the air outlet 236, as depicted by the air flow arrows 238. It should be understood that the air flow pattern depicted by the air flow arrows 238 is but one non-limiting example of the air flow pattern through the fan module 200. As the outer impeller 210 and the inner impeller 220 rotate, the first side 240 of the outer impeller 210, the first side 242 of the inner impeller 220, the second side 244 of the inner impeller 220, and the second side 246 of the outer impeller 210 each imparts incremental pressure on the air flowing through the fan module 200. The amount of incremental pressure may depend on various factors including, for example, the speed ratio, characteristics of the blades of the impellers (e.g., quantity, size, shape, curvature, angle, etc.), and the rotational speed of the impellers. Additionally, air flow through the top and bottom of the outer impeller 210 and the inner impeller 220 (that is, air flow in a direction substantially parallel to the first axis of rotation 212 and the second axis of rotation 222) may be substantially reduced. Accordingly, by virtue of the foregoing air flow pattern, the fan module 200 may be described as a side-in and side-out fan module.

Figure 3:
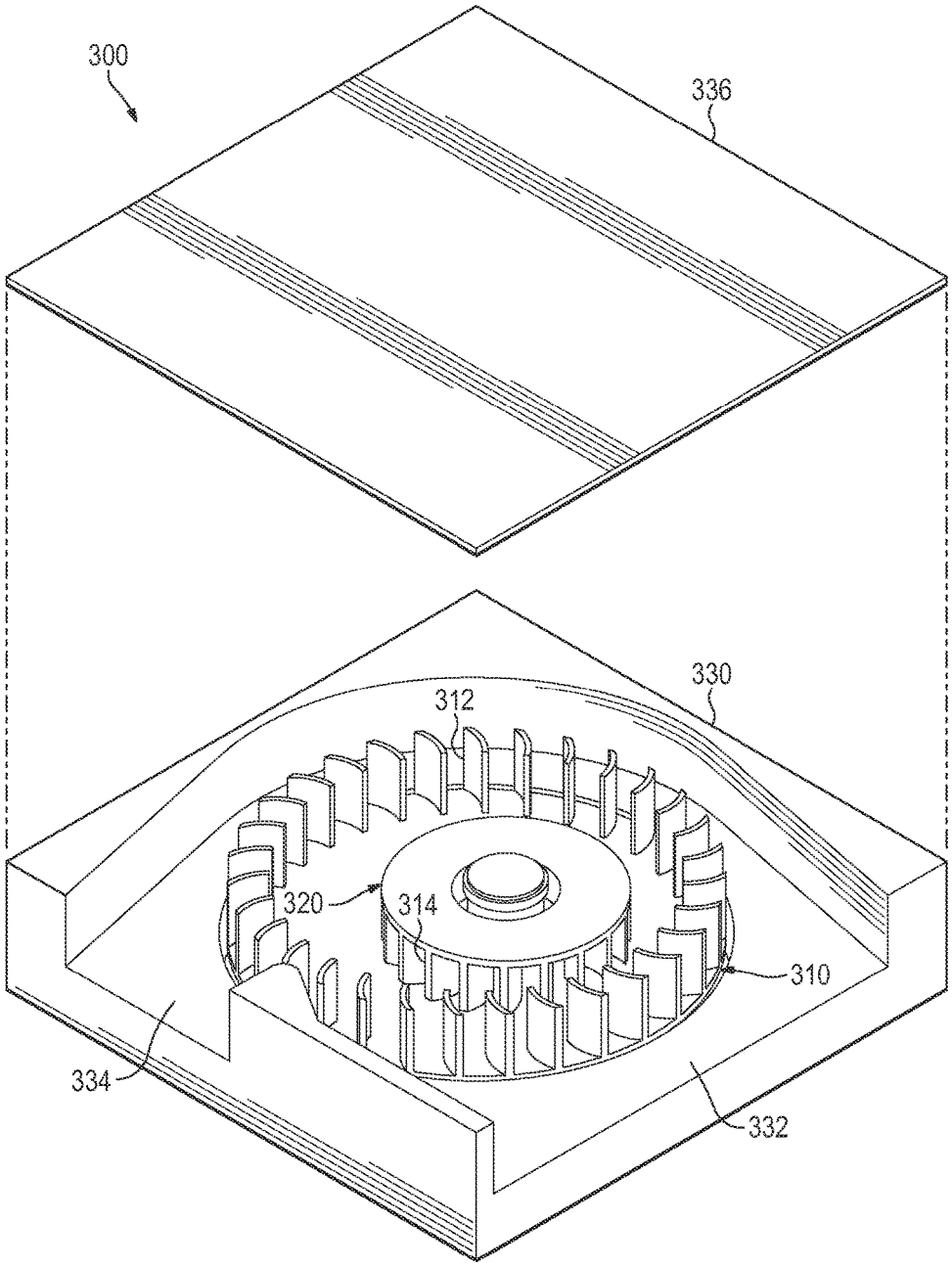
FIG. 3 is a perspective view of an example fan module according to an implementation.

FIG. 3 is a perspective view of an example fan module 300 according to an implementation. Fan module 300 may be analogous in many respects to the fan module 200 of FIG. 2. For example, as with the fan module 200, the fan module 300 may include an outer impeller 310 having a first plurality of blades 312 and an inner impeller 320 having a second plurality of blades 314. The outer impeller 310 and the inner impeller 320 may be disposed within a housing 330. The housing 330 may have an air inlet 332 and an air outlet 334. In some implementations, the outer impeller 310 and the inner impeller 320 may be fully enclosed by the housing 330 apart from openings at the air inlet 332 and the air outlet 334, such that air flow through the fan module 300 follows a side-in and side-out air flow pattern (a surface 336 of the housing 330 is depicted as separated from the housing 330 in an exploded view to reveal the components enclosed therein).

Figure 4A:
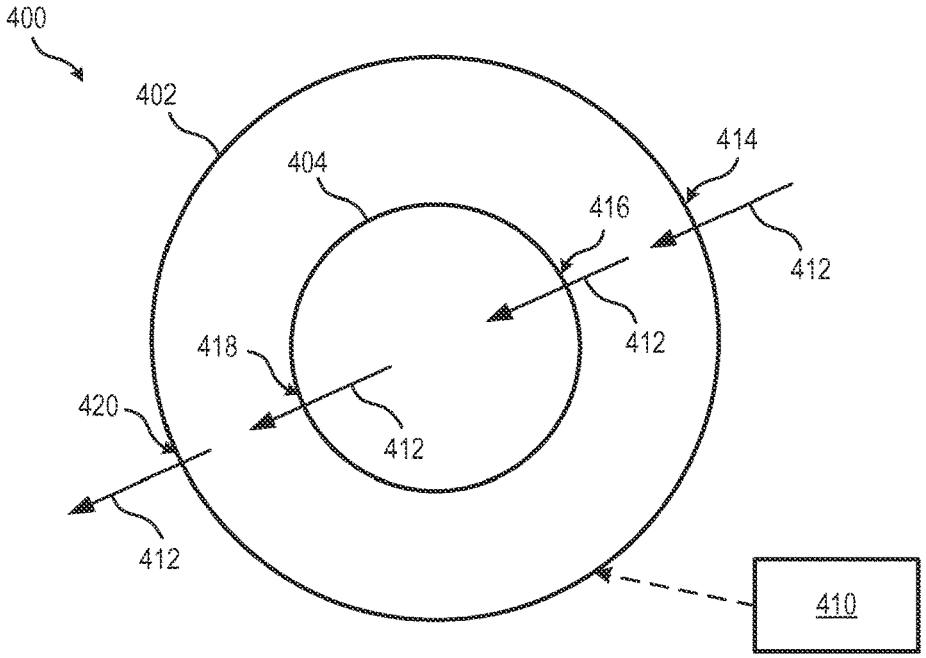
FIGS. 4A-4B illustrate an example fan module according to another implementation.
Figure 4B:
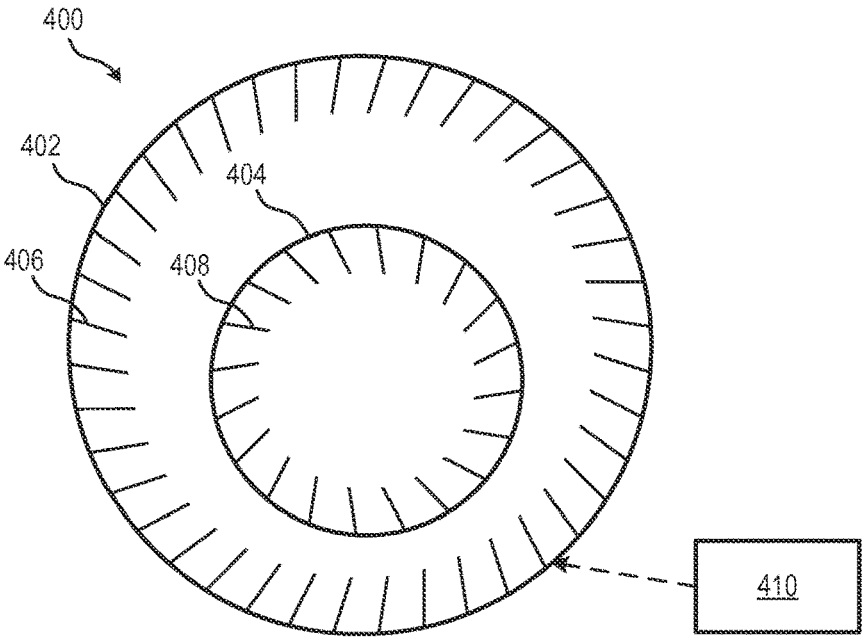

FIGS. 4A-4B illustrate an example fan module 400 according to an implementation. Fan module 400 may include impellers having different radii, each impeller of the impellers encircling a next smaller impeller of the impellers. For example, as depicted in FIG. 4A, an impeller 402 has a larger radius than an impeller 404, and impeller 402 is encircling the smaller impeller 404 (in other words, an impeller may be disposed within a next larger impeller). Each impeller may include a plurality of radial blades arranged in an outer annular portion of the each impeller (i.e., an outer ring area of the impeller). For example, as depicted in FIG. 4B, impeller 402 may have a plurality of radial blades 406 and the impeller 404 may have a plurality of radial blades 408.

Referring again to FIG. 4A, the fan module 400 may also include a motor 410, which may cause the impellers (e.g., impellers 402, 404) to rotate. Rotation of an impeller may be, for example, around a center axis of that impeller. In particular, each impeller may be rotatably coupled to at least one other impeller (e.g., by gearing, a pulley, or the like), and the motor 410 may cause the plurality of impellers to rotate by imparting rotation to one of the impellers. Rotation of the impellers may cause air to flow through a first side of each of the impellers in sequence from a largest impeller of the impellers to a smallest impeller of the impellers and then through a second side of each of the impellers in sequence from the smallest impeller to the largest impeller. For example, as depicted by the arrows 412 in FIG. 4A, air flows through a first side 414 of the larger impeller 402, then through a first side 416 of smaller impeller 404, then through a second side 418 of the smaller impeller 404, and then through a second side 420 of the larger impeller 402. As the impellers rotate, the first side of each of the impellers (e.g., first sides 414, 416) and the second side of each the impellers (e.g., second sides 418, 420) impart incremental pressure on the air flowing through the impellers. The amount of incremental pressure may depend on various factors including, for example, the speed ratio, characteristics of the blades of the impellers (e.g., quantity, size, shape, curvature, angle, etc.), and the rotational speed of the impellers. In some implementations, the fan module 400 may be enclosed in a housing analogous to the housing 232 of FIG. 2.

Figure 5:
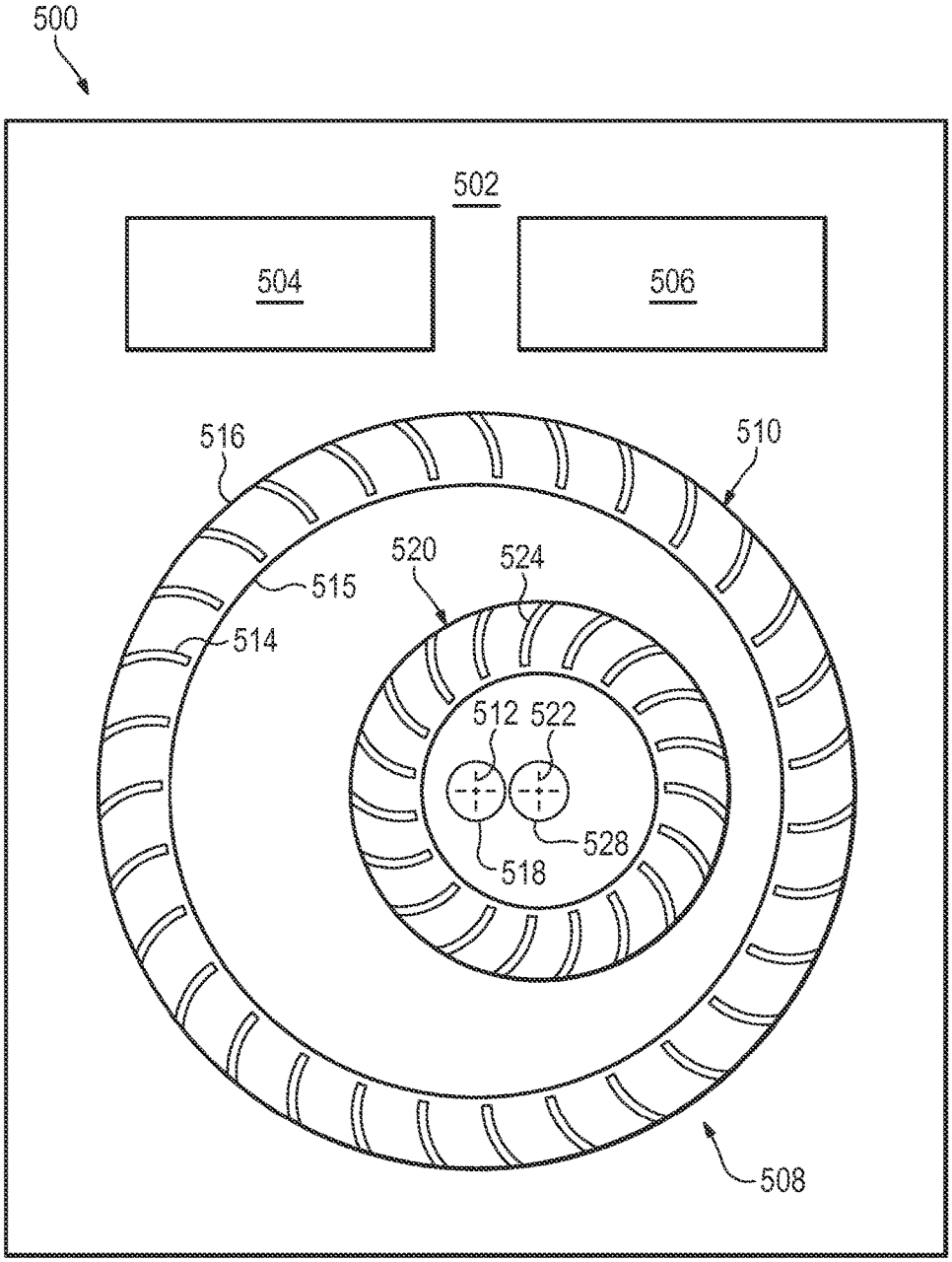
FIG. 5 is a block diagram of an example system that includes a fan module according to an implementation.

FIG. 5 is a block diagram of an example system 500 according to an implementation. The system 500 may be or may form part of an electronic device, such as, for example, a laptop computer, a desktop computer, a workstation, a tablet computing device, a mobile phone device, a server, a gaming device, or a storage device. The system 500 may include an enclosure 502, an electronic module 504, a motor 506, and a fan module 508. The electronic module 504, the motor 506, and/or the fan module 508 may each be disposed within the enclosure 502. The enclosure 502 may be or form part of an internal and/or external casing (or chassis) of the system 500. The electronic module 504 may be at least one heat-generating electronic component of the system 500, such as, for example, a processor, an input/output component, a networking component, a memory component, a storage component, a display component, a battery, or the like.

The fan module 508 may be analogous in many respects to any of the fan modules 100, 200, 300, and 400 described above. For example, the fan module 508 may include an outer impeller 510 that is rotatable about a first axis of rotation 512, has a first plurality of radial blades 514 arranged between an inner circumference 515 of the outer impeller 510 and an outer circumference 516 of the outer impeller 510, and has an outer impeller shaft 518 coaxial with the first axis of rotation 512. The fan module 508 may also include an inner impeller 520 that is rotatable about a second axis of rotation 522, is disposed within the inner circumference 515 of the outer impeller 510, has a second plurality of radial blades 524, and has an inner impeller shaft 528 coaxial with the second axis of rotation 522. The motor 506 may be coupled (e.g., by gearing, a pulley, etc.) to the outer impeller 510, the inner impeller 520, or both the outer impeller 510 and the inner impeller 520. More particularly, the motor 506 may be coupled to the outer impeller shaft 518 and/or the inner impeller shaft 528. In some implementations, rotation of the motor 506 may cause the outer impeller 510 and the inner impeller 520 to rotate in opposite directions. In other implementations, rotation of the motor 506 may cause the outer impeller 510 and the inner impeller 520 to rotate in the same direction.

In some implementations, the electronic module 504 may control a speed of the motor 506 based on a temperature, such as a temperature of the electronic module 504 and/or the enclosure 502. For example, in some implementations, the electronic module 504 may be processor coupled to a machine-readable medium encoded with instructions for performing the functionality described below. Additionally or alternatively, the electronic module 504 may include a hardware device comprising electronic circuitry for implementing the functionality described below. The electronic module 504 may receive a temperature measurement of the electronic module 504 and/or the enclosure 502 (e.g., from a temperature sensor). In response to a high temperature measurement for example, the electronic module 504 may increase the speed of the motor 506 to rotate the impellers 510, 520 faster, which in turn may increase air flow through the system 500 to dissipate heat and lower the temperature. In another example, when the temperature measurement is low, the electronic module 504 may decrease the speed of the motor 506 to conserve energy.

In view of the foregoing, it can be appreciated that ample air flow and air pressure, for ventilating an electronic device for example, may be provided by a compact side-in and side-out fan module having an inner impeller disposed within an outer impeller. Moreover, by virtue of rotatably coupling the impellers, rotation of the impellers may be achieved efficiently by, for example, a single motor rather than multiple motors.

In the foregoing description, it should be understood that the fan modules illustrated in FIGS. 1, 2, 3, 4A, 4B, and 5 are non-limiting examples, and that other arrangements, designs, and quantities of impellers may be utilized without departing from the scope of the present disclosure.

In the foregoing description, numerous details are set forth to provide an understanding of the subject matter disclosed herein. However, implementation may be practiced without some or all of these details. Other implementations may include modifications and variations from the details discussed above. It is intended that the following claims cover such modifications and variations.

What is claimed:

1. A fan module for an electronic device, comprising:

an outer impeller having a first plurality of radial blades arranged between an inner circumference of the outer impeller and an outer circumference of the outer impeller, the outer impeller rotatable about a first axis of rotation and including an outer impeller shaft coaxial with the first axis of rotation; and an inner impeller having a second plurality of radial blades arranged between an inner circumference of the inner impeller and an outer circumference of the inner impeller, the inner impeller disposed within the inner circumference of the outer impeller and nonconcentric with respect to the outer impeller, the inner impeller rotatable about a second axis of rotation and including an inner impeller shaft coaxial with the second axis of rotation, wherein the outer impeller shaft and the inner impeller shaft are both disposed within the inner circumference of the inner impeller and are gear shafts that mesh with one another such that rotation of the outer impeller shaft or the inner impeller shaft causes rotation of both the outer impeller and the inner impeller, and wherein a radius of the inner impeller shaft is different from a radius of the outer impeller shaft such that a speed ratio of an angular velocity of the inner impeller to an angular velocity of the outer impeller is less than one or greater than one.

2. The fan module of claim 1, wherein the outer impeller and the inner impeller rotate in opposite directions.

3. The fan module of claim 1, wherein an inner space is defined within the inner circumference of the outer impeller, and the inner impeller is located in the inner space.

4. The fan module of claim 1, further comprising a motor to impart a rotation to the outer impeller or the inner impeller.

5. The fan module of claim 1, further comprising a housing having an air inlet and an air outlet, wherein the outer impeller and the inner impeller are disposed within the housing, and a rotation of the outer impeller and a rotation of the inner impeller cause air to flow from the air inlet, through a first side of the outer impeller and then a first side of the inner impeller and then the center of the inner impeller and then a second side of the inner impeller and then a second side of the outer impeller, and out through the air outlet.

6. The fan module of claim 5, wherein the first side of the outer impeller, the first side of the inner impeller, the second side of the inner impeller, and the second side of the outer impeller each imparts incremental pressure on the air flowing through as the outer impeller and the inner impeller rotate.

7. A system comprising:

an electronic module disposed within an enclosure;

a fan module disposed within the enclosure, the fan module including:

an outer impeller rotatable about a first axis of rotation, the outer impeller having a first plurality of radial blades arranged between an inner circumference of the outer impeller and an outer circumference of the outer impeller and having an outer impeller shaft coaxial with the first axis of rotation, and an inner impeller rotatable about a second axis of rotation, the inner impeller disposed within a space defined within the inner circumference of the outer impeller and having a second plurality of radial blades and an inner impeller shaft coaxial with the second axis of rotation, the second plurality of radial blades arranged between an inner circumference of the inner impeller and an outer circumference of the inner impeller, wherein the first axis of rotation is offset from the second axis of rotation, wherein the outer impeller shaft and the inner impeller shaft are both disposed within the inner circumference of the inner impeller and are gear shafts that mesh with one another such that rotation of the outer impeller shaft or the inner impeller shaft causes rotation of both the outer impeller and the inner impeller, and wherein a radius of the inner impeller shaft is different from a radius of the outer impeller shaft such that a speed ratio of an angular velocity of the inner impeller to an angular velocity of the outer impeller is less than one or greater than one; and a motor disposed within the enclosure and coupled to the outer impeller, or the inner impeller, or both the outer impeller and the inner impeller.

8. The system of claim 7, wherein the electronic module is to control a speed of the motor based on a temperature of the electronic module or of the enclosure.

9. The system of claim 7, wherein rotation of the motor causes the outer impeller and the inner impeller to rotate in opposite directions.

10. A fan module for an electronic device, comprising:

a plurality of impellers having different radii, an impeller of the plurality of impellers encircling a next smaller impeller of the plurality of impellers, wherein a first impeller of the plurality of impellers that is encircled by a second impeller of the plurality of impellers is nonconcentric with respect to the second impeller, wherein the second impeller includes a second impeller shaft coaxial with an axis of rotation of the second impeller, the first impeller includes a first impeller shaft coaxial with an axis of rotation of the first impeller, the second impeller shaft and the first impeller shaft are both disposed within an inner space of the first impeller and are gear shafts that mesh with one another such that rotation of the second impeller shaft or the first impeller shaft causes rotation of both the second impeller and the first impeller, and a radius of the second impeller shaft is different from a radius of the first impeller shaft such that a speed ratio of an angular velocity of the first impeller to an angular velocity of the second impeller is less than one or greater than one; and a motor to cause the plurality of impellers to rotate, wherein:

rotation of the plurality of impellers causes air to flow through a first side of each of the plurality of impellers in sequence from a largest impeller of the plurality of impellers to a smallest impeller of the plurality of impellers and then through a second side of each of the plurality of impellers in sequence from the smallest impeller to the largest impeller, and the first side of each of the plurality of impellers and the second side of each of the plurality of impellers impart incremental pressure on the air flowing through the impellers as the plurality of impellers rotate.

11. The fan module of claim 10, wherein each respective impeller of the plurality of impellers includes a plurality of radial blades arranged in an outer annular portion of the respective impeller.

12. The fan module of claim 10, wherein each impeller of the plurality of impellers is rotatably coupled to at least one other impeller, and the motor causes the plurality of impellers to rotate by imparting rotation to one of the plurality of impellers.

13. The fan module of claim 1, wherein a part of the outer impeller is at a same elevation as a part of the inner impeller.

14. The system of claim 7, wherein the outer impeller and the inner impeller that is within the space defined within the inner circumference are nonconcentric.

15. The system of claim 7, wherein the first plurality of radial blades are rotatable with rotation of the outer impeller shaft, and the second plurality of radial blades are rotatable with rotation of the inner impeller shaft.

16. The fan module of claim 10, wherein a space is defined within an inner circumference of the second impeller, and the first impeller that is nonconcentric with respect to the second impeller is located in the space.

* * * * *